US008091927B2

(12) United States Patent
Scanlon

(10) Patent No.: US 8,091,927 B2
(45) Date of Patent: Jan. 10, 2012

(54) GAS SUPPLY COUPLING FOR A WATER HEATER

(75) Inventor: James Scanlon, Novi, MI (US)

(73) Assignee: Brass Craft Manufacturing Company, Novi, MI (US)

( * ) Notice: Subject to any disclaimer, the term of this patent is extended or adjusted under 35 U.S.C. 154(b) by 1816 days.

(21) Appl. No.: 11/282,931

(22) Filed: Nov. 18, 2005

(65) Prior Publication Data

US 2007/0117060 A1 May 24, 2007

(51) Int. Cl.
*F16L 5/00* (2006.01)

(52) U.S. Cl. ..... 285/136.1; 285/141.1; 285/148.1; 285/148.23; 285/235

(58) Field of Classification Search ..... 285/136.1, 285/141.1, 145.4, 145.5, 148.1, 148.23, 148.26, 285/226, 229, 235–236, 286.2; 431/249, 431/343

See application file for complete search history.

(56) References Cited

U.S. PATENT DOCUMENTS

| | | | | | |
|---|---|---|---|---|---|
| 196,084 | A * | 10/1877 | Guyer | 285/148.11 |
| 1,253,065 | A * | 1/1918 | Looze | 285/85 |
| 3,209,991 | A * | 10/1965 | Sauber | 417/415 |
| 3,871,800 | A * | 3/1975 | Slayton | 418/248 |
| 5,386,923 | A * | 2/1995 | Nakashima et al. | 220/86.2 |
| 6,257,846 | B1 * | 7/2001 | Muramatsu et al. | 417/410.3 |
| 6,517,344 | B2 | 2/2003 | Scanlon | |
| 2002/0068253 | A1 * | 6/2002 | Scanlon | 431/343 |

FOREIGN PATENT DOCUMENTS

| | | |
|---|---|---|
| GB | 397360 | 8/1933 |
| JP | 2001254834 | 9/2001 |

OTHER PUBLICATIONS

Photographs of Allegan Tubular Products hot water heater assembly, Oct. 11, 2004.

* cited by examiner

*Primary Examiner* — Aaron Dunwoody
*Assistant Examiner* — Fannie Kee
(74) *Attorney, Agent, or Firm* — Carlson Gaskey & Olds, P.C.

(57) ABSTRACT

A gas supply coupling is disposed within and extends through an opening of a combustion chamber for a water heater. The coupling includes a fitting which is a relatively inexpensive stamped component. A stepped tubular connection extends from a plate and includes a first portion having a first diameter which necks down to a second portion having a second diameter less than the first diameter. The stepped tubular connection receives a gas supply tube into the first portion and a gas supply line over the second portion. The tubes are braised to the stepped connection. Other gas supply couplings include a machined fitting and a direct connection between a gas supply tube and a gas supply line in which the gas supply tube itself provides for both the seal to the shield and the connection to the gas supply line.

11 Claims, 9 Drawing Sheets

GAS SUPPLY COUPLING FOR A WATER HEATER

BACKGROUND OF THE INVENTION

The present invention relates to a gas supply coupling for delivering natural gas to a combustion chamber of a water heater and, in particular, to an inexpensive coupling incorporating a shield which facilitates connection between a gas supply line and a gas supply tube.

Domestic water heaters use either electricity or a combustible fuel to heat a supply of water for use on demand by the homeowner. The fuel may include propane or natural gas which are delivered to a combustion chamber proximate the water tank. The fuel is combusted within the combustion chamber to heat and maintain the water at a predetermined temperature. In order to service and deliver fuel to the combustion element, the combustion chamber is typically open to the exterior of the water heater. This may create a path for other gases to reach the combustion element.

Water heater combustion chambers eliminate exterior combustion by utilizing a functionally sealed combustion chamber which controls the gas flow exteriorly of the chamber. The sealed chamber, however, may complicate manufacture and assembly of the water heater. A sealed chamber reduces many of the assembly tolerances between the control unit/regulator and the burner. In addition, the gas supply must pass through a sealed door for delivery of the combustion fuel. One such sealed door includes a flare connection and threaded nut fitting between a gas supply line which extends outside of the combustion chamber and a gas supply tube on the interior. Although effective, the connection components are rather expensive which further increases the per unit water heater manufacturing expense.

Accordingly, it is desirable to provide an uncomplicated and inexpensive connection through a water heater sealed door.

SUMMARY OF THE INVENTION

A gas supply coupling according to the present invention is disposed within and extends through an opening of a combustion chamber of a water heater. The supply coupling delivers combustible fuel to a burner. The supply coupling includes a bulkhead shield configured to seat within the opening thereby closing this pathway into the combustion chamber. Mounted in the shield is a coupling which provides interconnection between a gas supply line and a gas supply tube. The gas supply line is a flexible line which is connected to a gas supply. The gas supply tube is a rigid tube with an outlet port at the burner for delivering the fuel to the burner.

The coupling includes a fitting that is a relatively inexpensive stamped component. The fitting includes a plate having a stepped outer periphery for receipt into the shield. The plate is staked or welded into the shield. A stepped tubular connection extends from the plate and includes a first portion having a first diameter which necks down to a second portion having a second diameter less than the first diameter. The stepped tubular connection receives the gas supply tube into the first portion and the gas supply line over the second portion.

Another fitting includes a plate having an opening in which a gas supply tube having a reduced diameter portion is received. The gas supply tube is braised within the opening of the fitting and the gas supply line is braised directly to the reduced diameter portion of the gas supply tube.

Another fitting is a machined component having a head and a tubular male segment of a constant diameter. The head defines an opening sized to receive the gas supply tube. The tubular male segment receives the gas supply line through a braised or bonded attachment. Another coupling includes a crimp ring crimped over the gas supply line and the tubular male segment.

Yet another embodiment of the coupling is a direct connection between a gas supply tube and a gas supply line in which the gas supply tube itself provides for both the seal to the shield and the connection to the gas supply line. The gas supply tube includes a reduced diameter interference fit section, a seal section, and a crimp section. The reduced diameter interference fit section and a bulged segment of the gas supply line provides an interference seal such that the crimp section need only retain the gas supply line within the gas supply tube and need not provide a sealing function. A spot weld or adhesive may alternatively or additionally be provided to secure the gas supply line within the gas supply tube.

The present invention therefore provides uncomplicated and inexpensive connections through a water heater sealed door.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
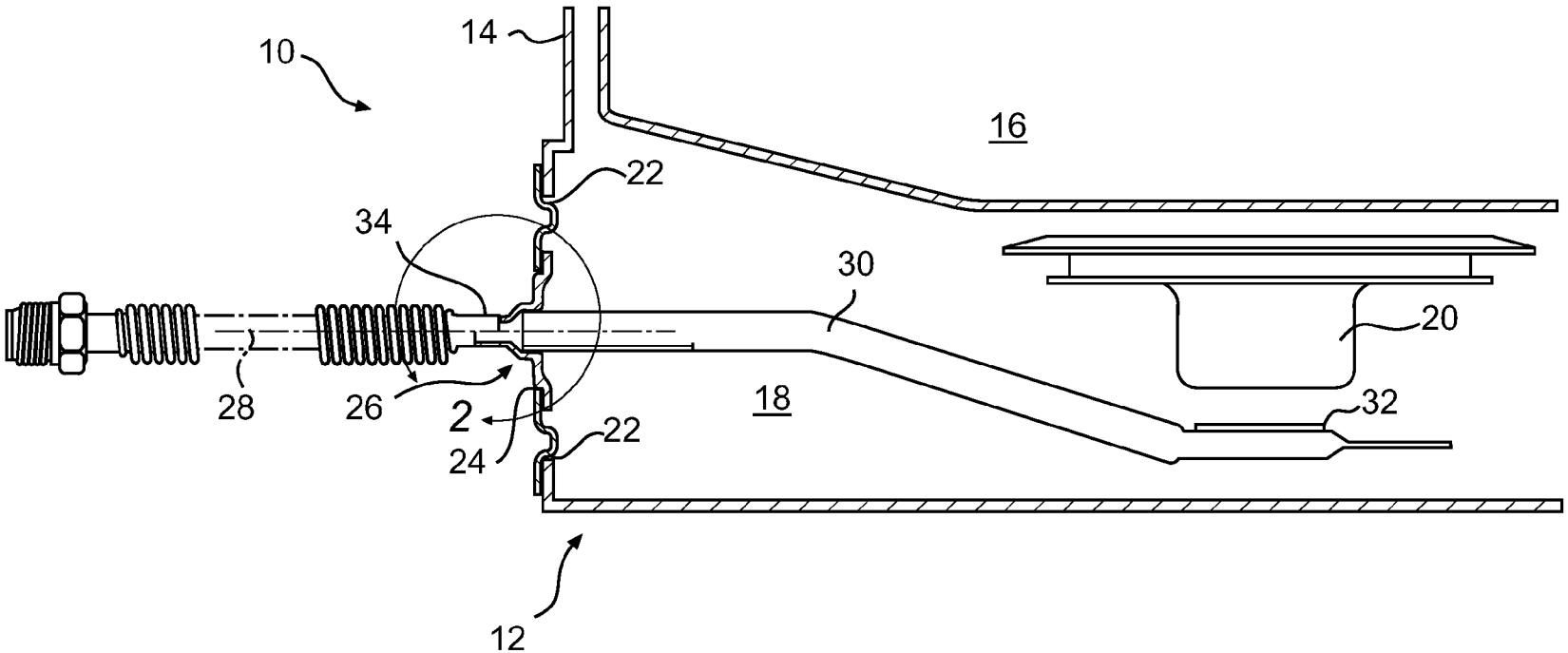
FIG. 1 is a general side view of a gas supply coupling for a water heater embodied in the present invention.

FIG. 1 illustrates a general perspective view of a gas supply assembly 10 in conjunction with a water heater 12 having a housing 14. The water heater housing 14 is compartmentalized to include a water tank 16 and a combustion chamber 18. Disposed within the combustion chamber 18 is a burner 20 in close proximity to the water tank 16. The gas supply assembly 10 of the present invention is designed to deliver fuel to the burner 20 for combustion proximate the water tank 16 thereby heating the water within the tank 16 to a predetermined temperature. The gas supply assembly 10 will be connected to a fuel supply which in the preferred embodiment is natural gas although it is contemplated that the gas supply assembly 10 may be used with other fuel types including propane. The combustion chamber 18 includes an opening 22 to the exterior of the water heater 12 to facilitate access to the gas supply and combustion elements. However, this opening 22 may also form a pathway for foreign elements and gases to reach the burner 20.

The gas supply assembly 10 is disposed within and extends through the opening 22 of the combustion chamber 18. The gas supply assembly 10 includes a bulkhead shield 24 configured to seat within the opening 22 thereby closing this pathway into the combustion chamber 18. Mounted to the shield 24 is a coupling 26 which provides interconnection between a gas supply line 28 and a gas supply tube 30. The gas supply line 28 is preferably a flexible line which is connected to the fuel supply. The gas supply tube 30 is preferably a rigid tube with an outlet port 32 at the burner 20 for delivering the fuel to the burner 20. The gas supply line 28 is preferably connected to the gas supply tube 30 by way of a fitting 34. Various fittings 34 are described in detail below.

Figure 2A:
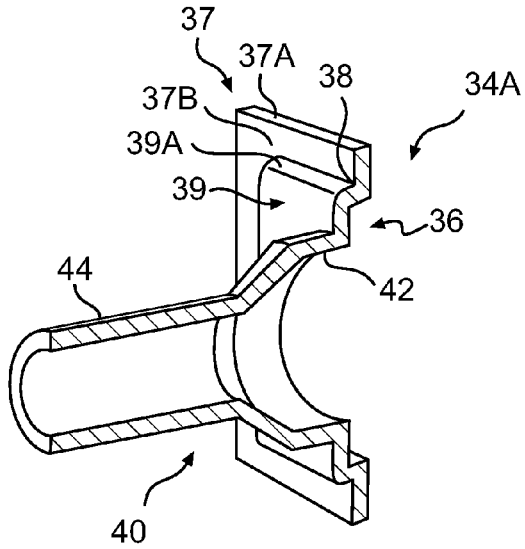
FIG. 2A is a perspective view of a fitting for the gas supply coupling.

Referring to FIG. 2A, the coupling 26 includes a fitting 34A which is preferably a relatively inexpensive stamped component. The fitting 34A includes a plate 36 having first and second plate sections 37, 39. A stepped outer periphery 38 is defined between the first and second plate sections 37, 39. Notably, as shown, the first plate section 37 has a larger outer perimeter 37A than the outer perimeter 39A of the second plate section 39. Further, the first plate section 37 includes an abutment surface 37B between the outer perimeters 37A, 39A of the first and second plate sections 37, 39, and the second plate section 39 generally extends outward from the abutment surface 37B. As in FIG. 2B, the abutment surface 37B may abut the shield 24 when the fitting 34A is received into the shield 24. The plate 36 preferably has a non-circular profile and is staked or welded into the shield 24, however other attachments may also be utilized.

Figure 2B:
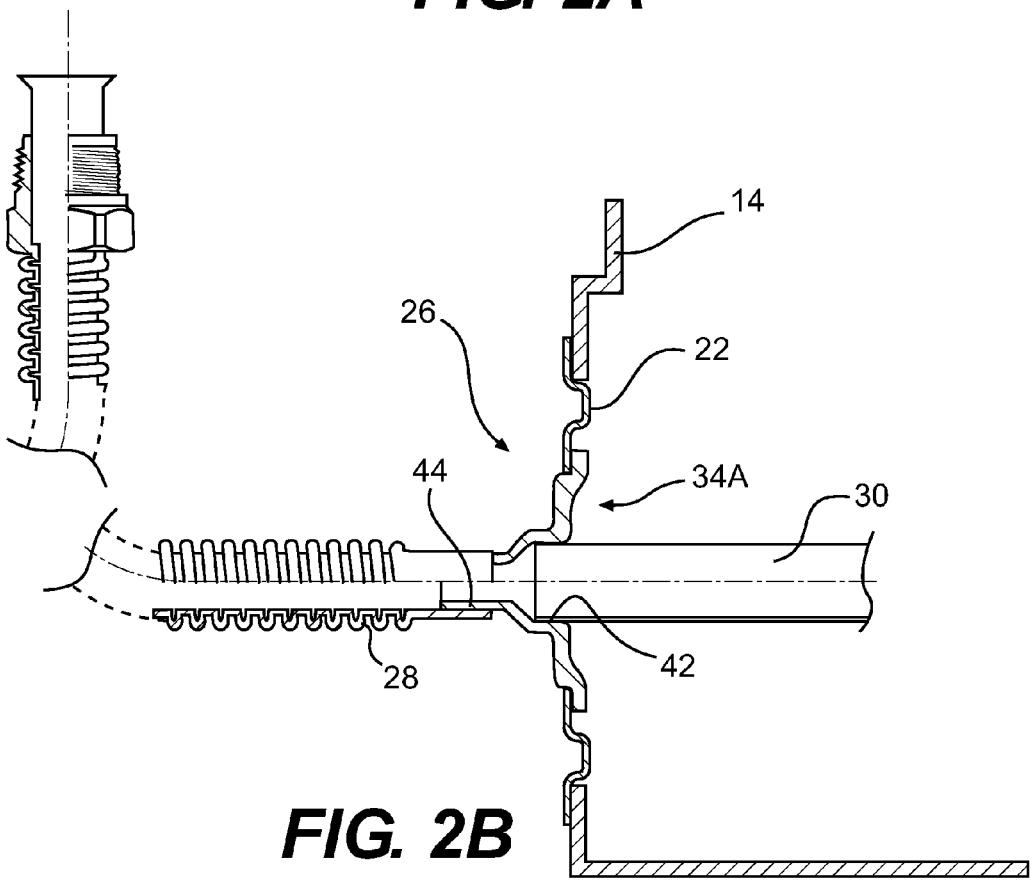
FIG. 2B is a sectional side view of the fitting of FIG. 2A mounted within an opening defined in the housing of a water heater.

A stepped tubular connection 40 extends from the plate 36 and includes a first portion 42 having a first diameter which necks down to a second portion 44 having a second diameter less than the first diameter. Again, such an uncomplicated design readily facilitates manufacture as a stamping. The stepped tubular connection 40 receives the gas supply tube 30 into the first portion 42 and the gas supply line 28 over the second portion 44 (FIG. 2B). It should be understood that other male/female receipt arrangements may also be utilized. The tubes 28, 30 are preferably braised to the stepped tubular connection 40, however, other attachments methods may alternatively or additionally be utilized such as adhesives, crimping and such like.

Figure 3A:
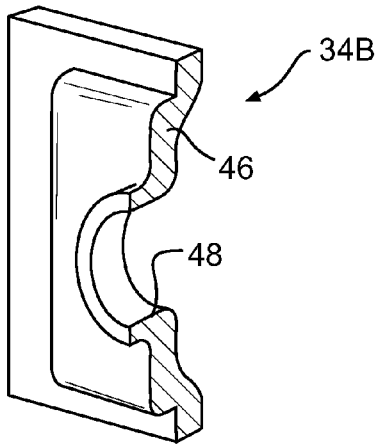
FIG. 3A is a perspective view of another fitting for a gas supply coupling.

Referring to FIG. 3A, another fitting 34B includes a plate 46 having an opening 48. The plate 46 is braised or welded into the shield 24 as described above as the plate 46 is essentially the same as the plate 36. Again, such an uncomplicated design readily facilitates manufacture as a stamping.

Figure 3B:
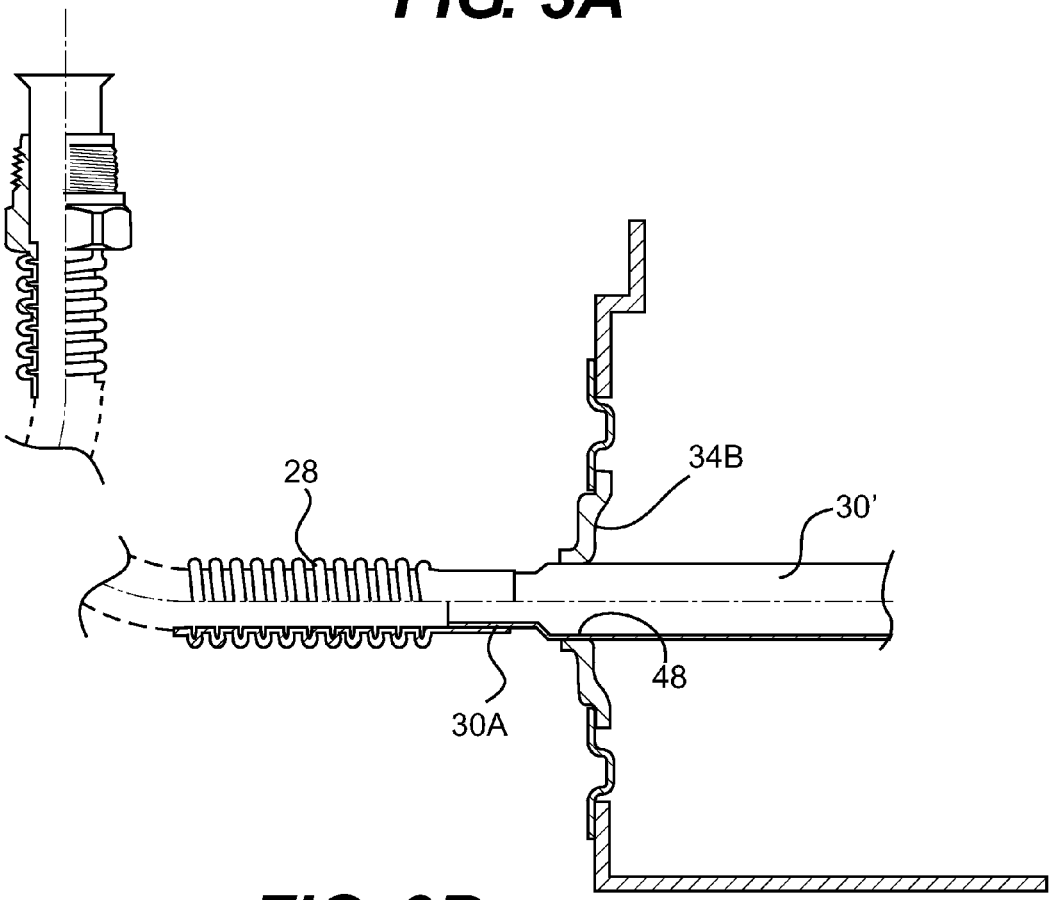
FIG. 3B is a sectional side view of the fitting of FIG. 3A mounted within an opening defined in the housing of a water heater.

Referring to FIG. 3B, this fitting 34B utilizes a gas supply tube 30' which includes a reduced diameter portion 30a which receives the gas supply line 28 directly. That is, the gas supply tube 30' is braised within the opening 48 of the fitting 34B and the gas supply line 28 is braised directly to the reduced diameter portion 30*a* of the gas supply tube 30'.

Figure 4A:
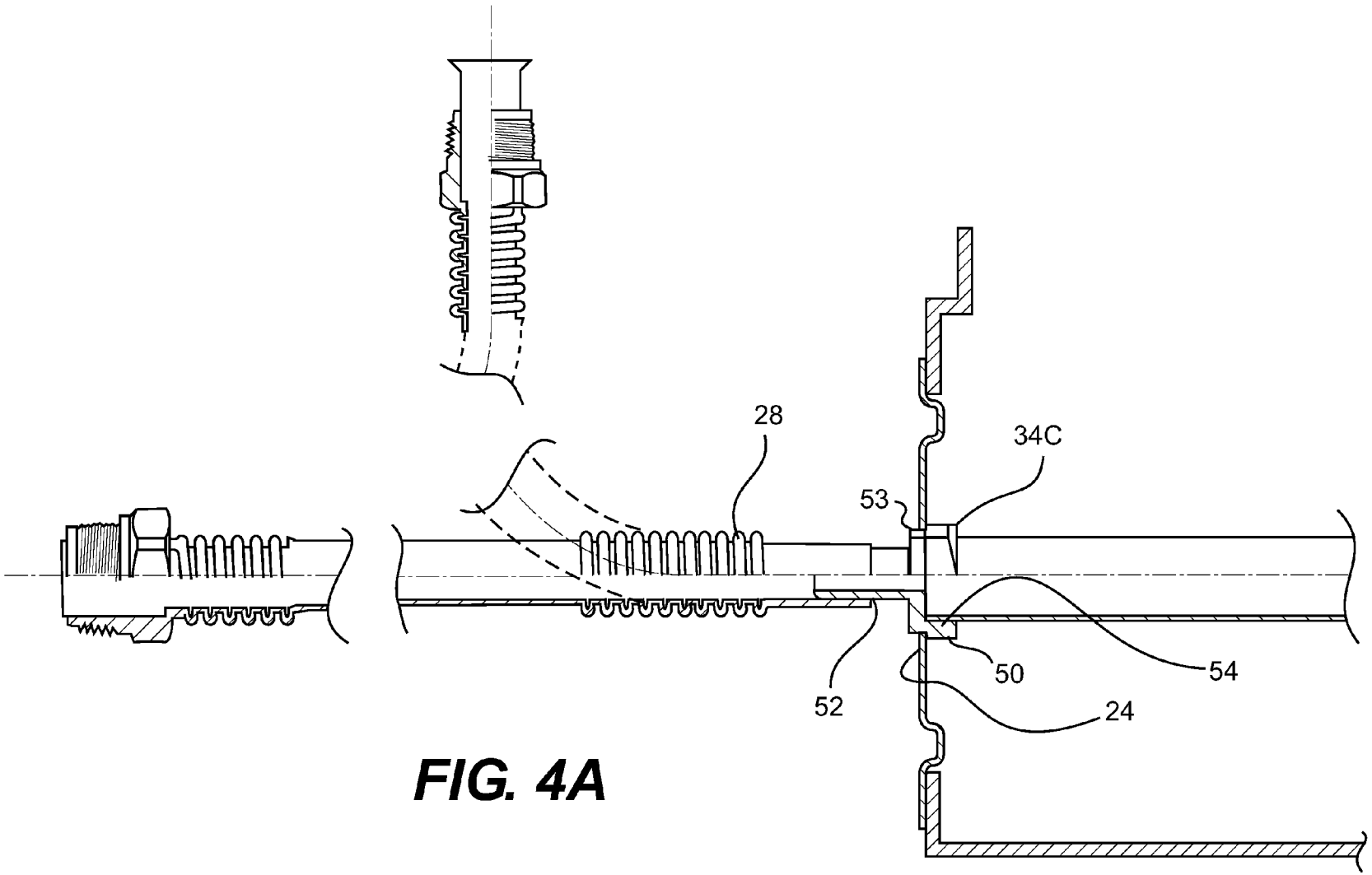
FIG. 4A is a sectional side view of a machined fitting for a gas supply coupling according to the present invention.

Referring to FIG. 4A, another fitting 34C is preferably a machined component. Although slightly more expensive to manufacture, a more complex shape is readily provided. The fitting 34C is a bulkhead fitting having a head 50 and a tubular male end 52 of a constant diameter. The head 50 includes a stepped surface similar to that described above to facilitate insertion and braising into the shield 24. The head 50 defines an opening 54 sized to receive the gas supply tube 30 which is braised or otherwise attached therein. The tubular male end 52 is fitted within the gas supply line 28 which is braised thereon or attached thereto with an adhesive such as LOCKTITE (r) or the other anaerobic adhesive. The adhesive bond would supply the structural strength. The tubular male end 52 is, however, simplified in that the previously required threads and flare surface are eliminated thereby reducing manufacturing costs.

Figure 4B:
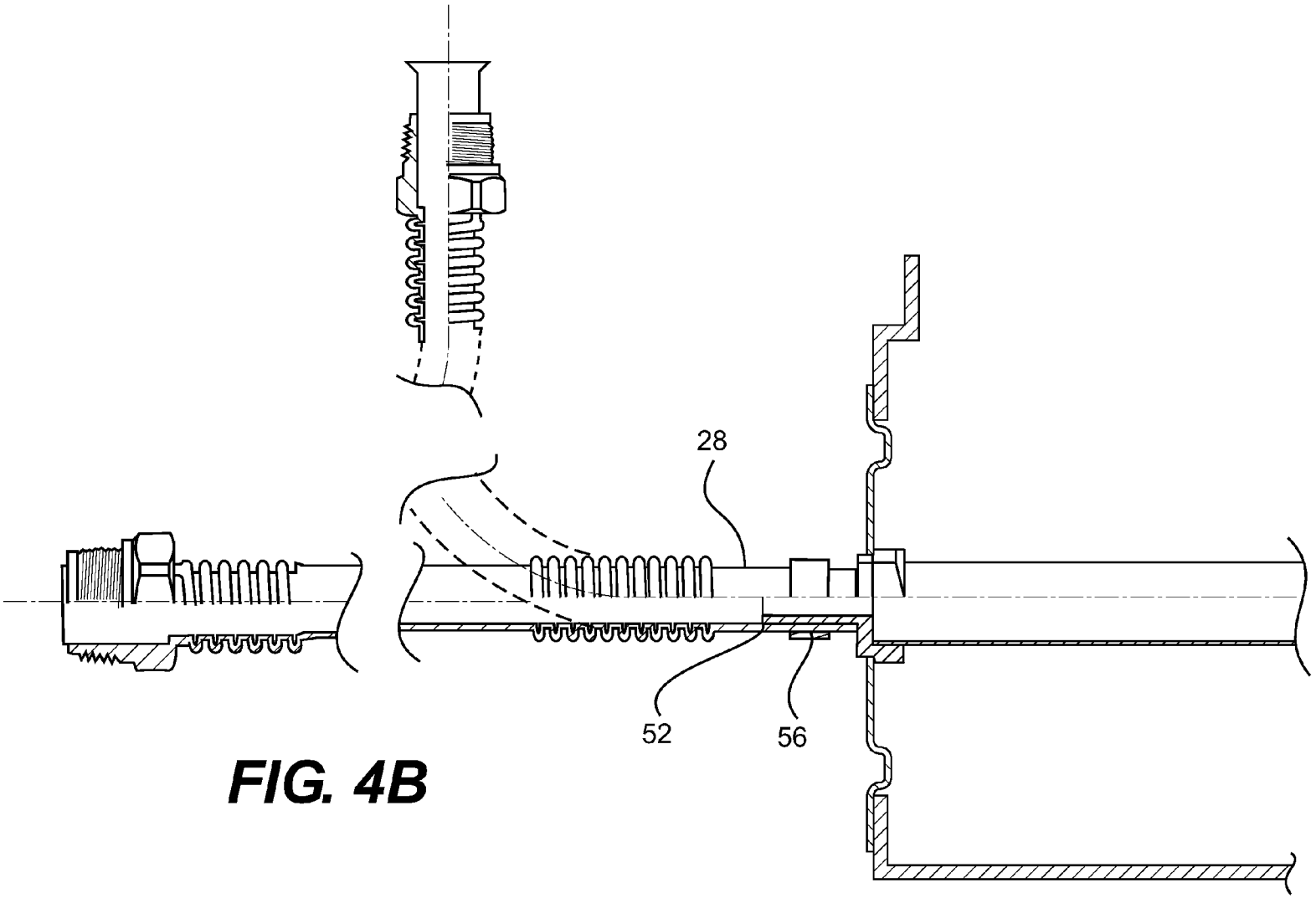
FIG. 4B is a sectional side view of the coupling illustrated in FIG. 4A reinforced with a crimp ring.

Referring to FIG. 4B, a crimp ring 56 is crimped over the gas supply line 28 and the tubular male segment 52 as an alternative or in addition to the attachment described with regard to FIG. 4A. The crimp ring 56 further prevents the possibility of the relatively soft gas supply line 28 from loosening should the adhesive fail after a prolonged time period.

Figure 5A:
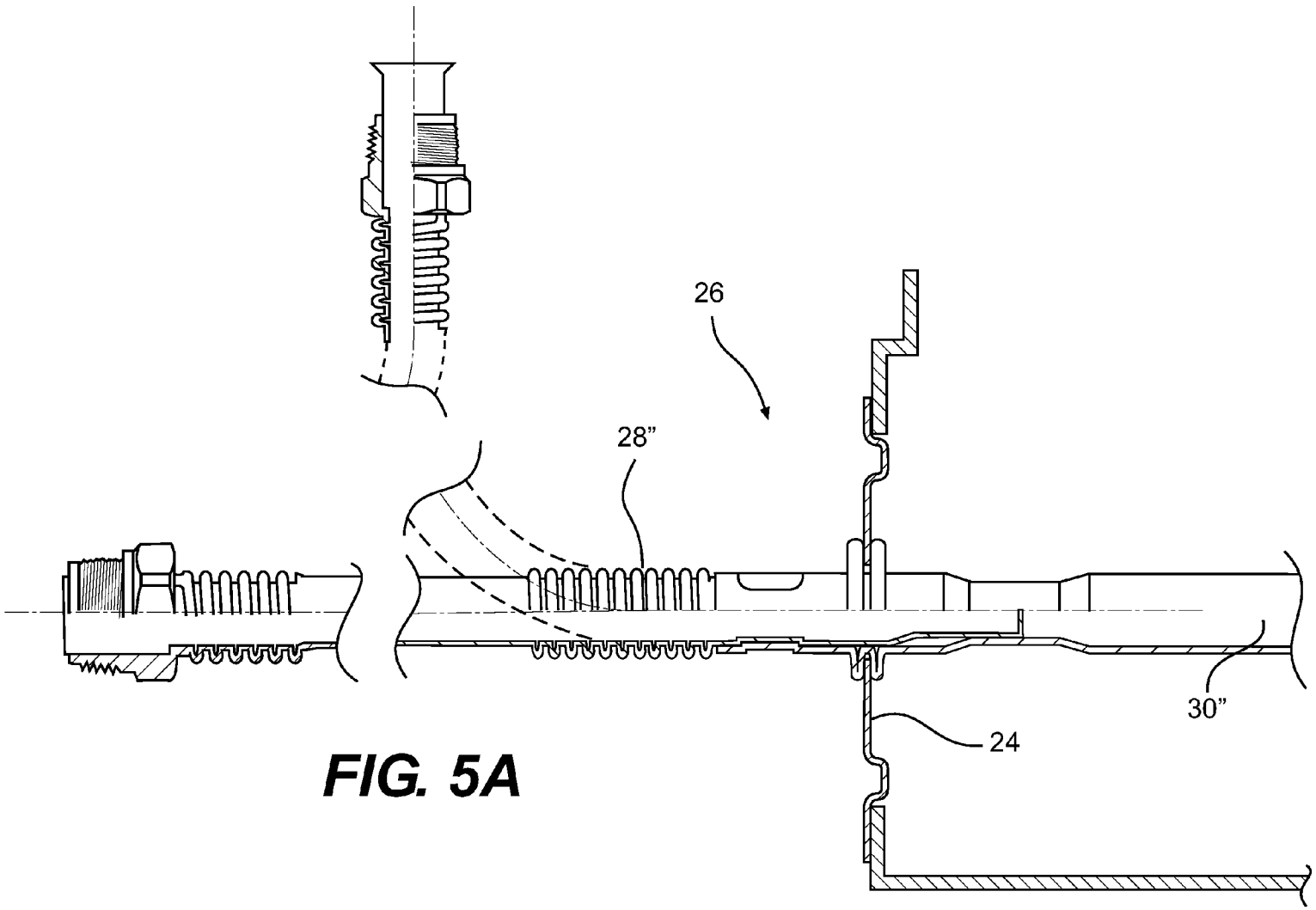
FIG. 5A is a sectional side view of another gas supply coupling which directly couples a gas supply line with a gas supply tube.

Referring to FIG. 5A, another embodiment of the coupling 26 is a direct connection between a gas supply tube 30" and a gas supply line 28". The gas supply tube 30" provides for both the seal to the shield 24 and the connection to the gas supply line 28".

Figure 5B:
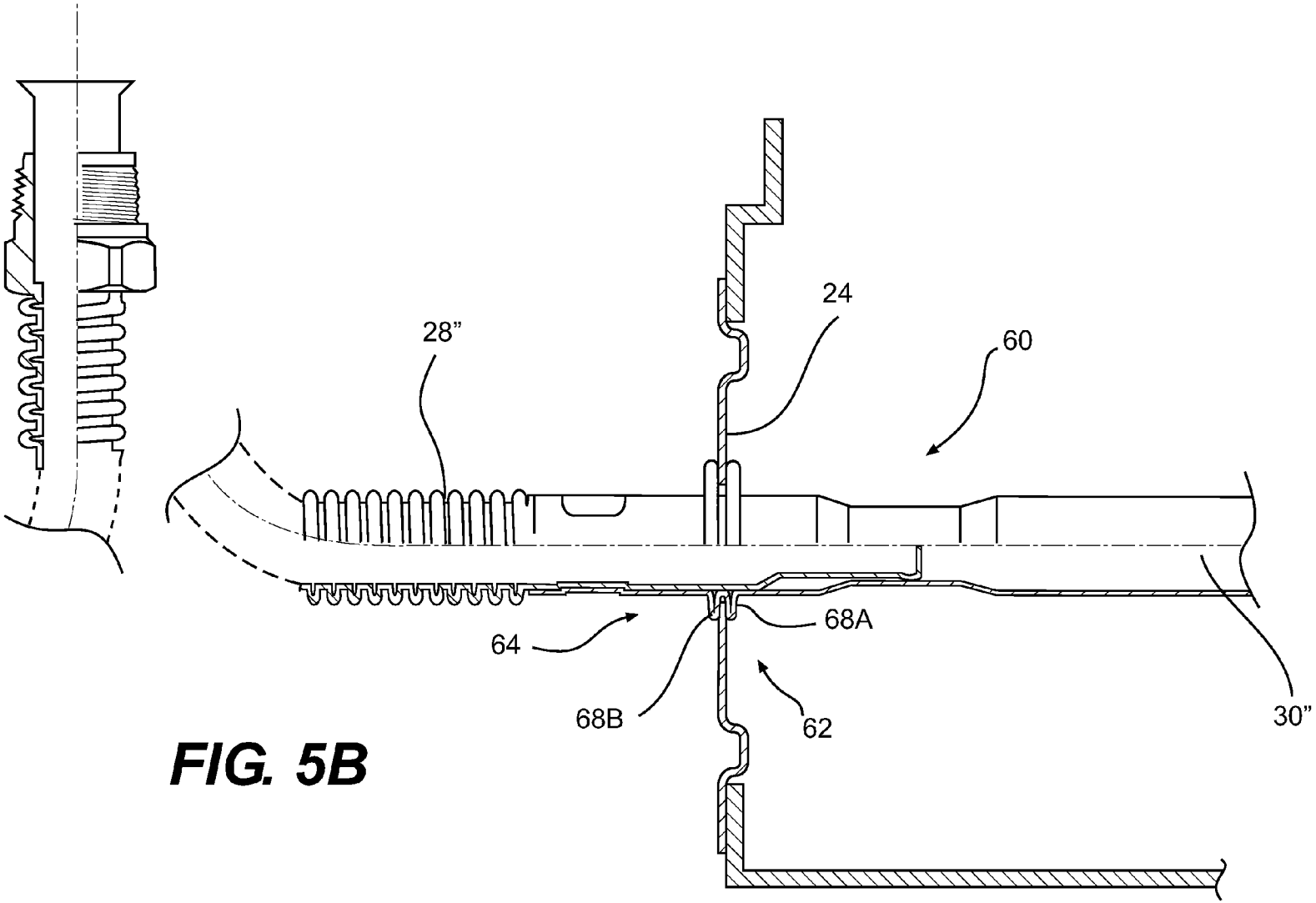
FIG. 5B is an expanded sectional side view of the gas supply coupling illustrated in FIG. 5A.
Figure 5C:
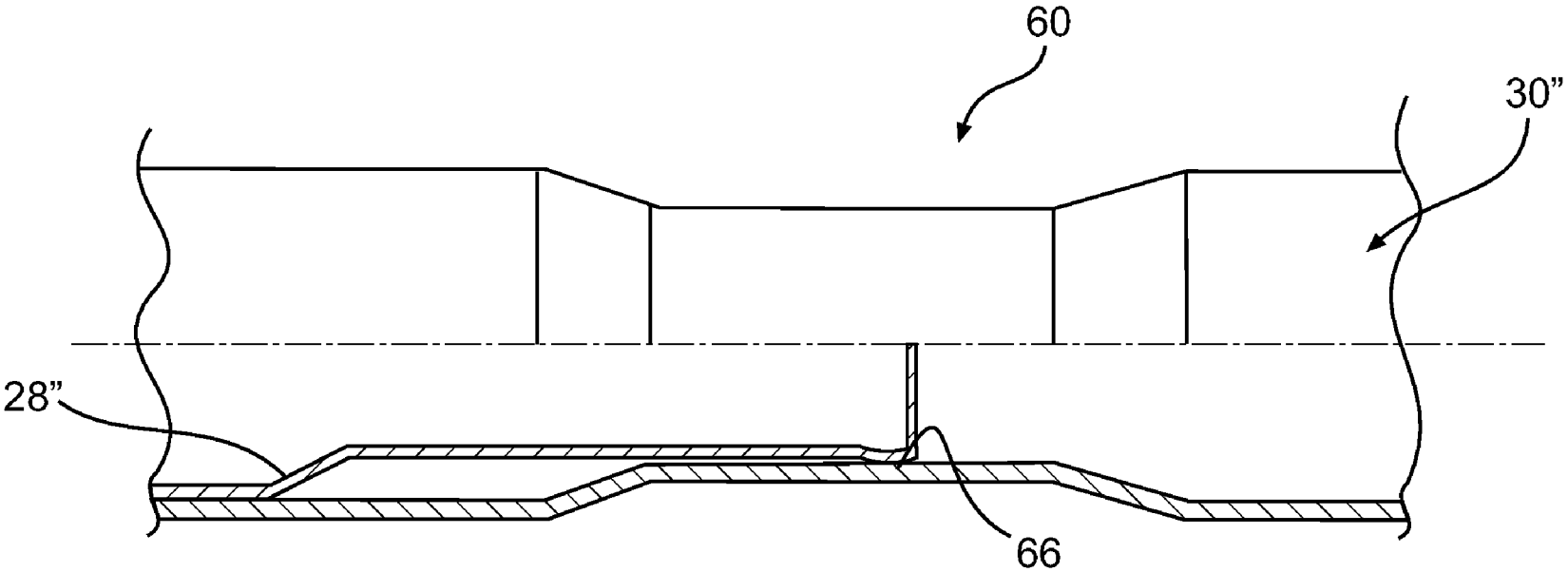
FIG. 5C is an expanded sectional side view of a reduced diameter interference fit section of the gas supply tube illustrated in FIGS. 5A and 5B.
Figure 5D:
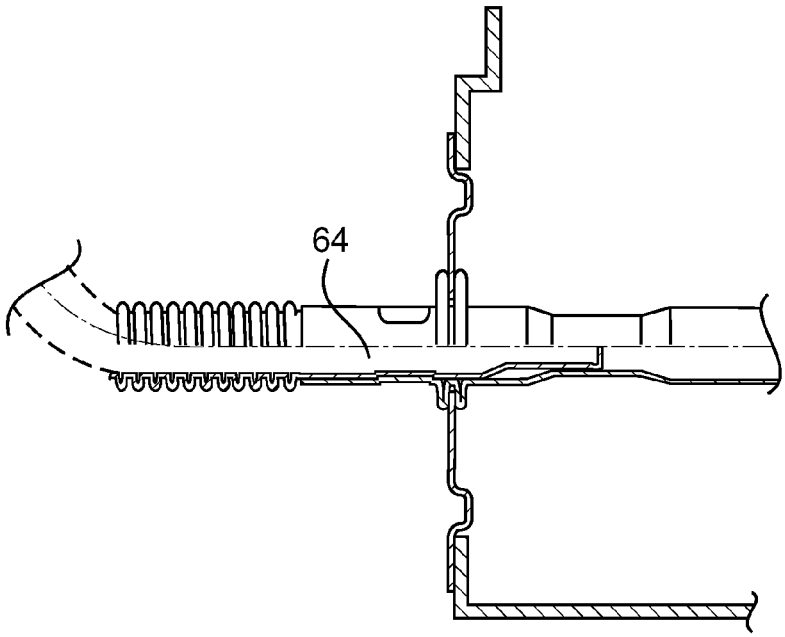
FIG. 5D is a sectional side view of the gas supply line with an alternate location for a bulged segment in the gas supply line.
Figure 5E:
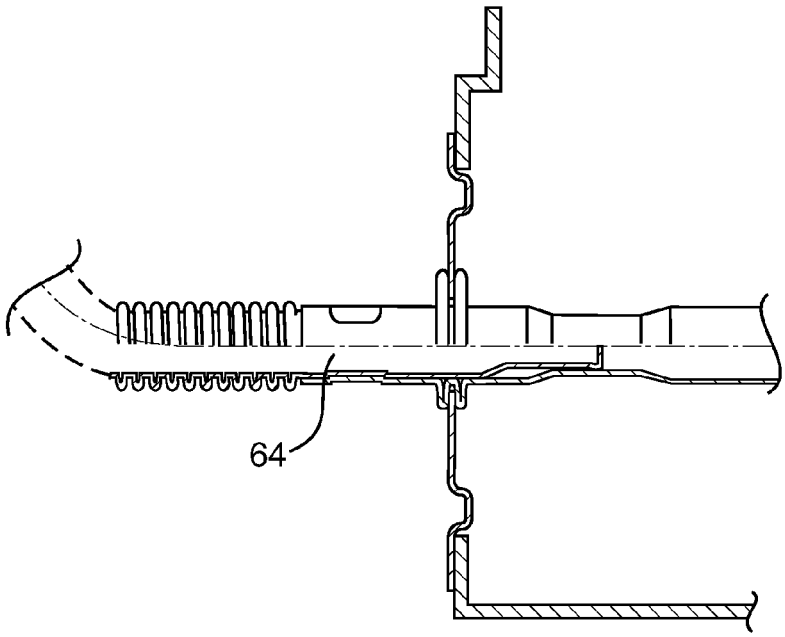
FIG. 5E is a sectional side view of the gas supply line with an alternate location for a bulged segment in the gas supply line.

Referring to FIG. 5B, the gas supply tube 30" includes a reduced diameter interference fit section 60, a seal section 62, and a crimp section 64. The reduced diameter interference fit section 60 receives a bulged segment 66 of the gas supply line 28" therein to provide a gas tight seal therebetween (FIG.5C). It should be understood that the bulged segment 66 need not be located at the distal end of the gas supply line 28". The reduced diameter interference fit section 60 is preferably of an axial length to provide for the axial positional tolerance for the receipt of the bulged segment 66 of the gas supply line 28". The interference seal may alternatively be located behind the shield 24 relative to the housing 14, external to the housing 14 but prior to the crimp section 64 (FIG.5D) or external to the crimp section 64 (FIG. 5E) adjacent a distal end of the gas supply tube 30".

The seal section 62 includes an inner pinched section 68*a* and an outer pinched section 68*b* to trap the shield 24 there between. That is, the gas supply tube 30" is formed essentially around the shield 24.

As the reduced diameter interference fit section 60 and the bulged segment 66 of the gas supply line 28" provide the interference seal, the crimp section 64 need only retain the gas supply line 28" within the gas supply tube 30" and need not provide a sealing function. A spot weld or adhesive may alternatively or additionally be provided to secure the gas supply line 28" within the gas supply tube 30".

It should be understood that relative positional terms such as "forward," "aft," "upper," "lower," "above," "below," and the like are with reference to the normal operational attitude of the vehicle and should not be considered otherwise limiting.

It should be understood that although a particular component arrangement is disclosed in the illustrated embodiment, other arrangements will benefit from the instant invention.

Although particular step sequences are shown, described, and claimed, it should be understood that steps may be performed in any order, separated or combined unless otherwise indicated and will still benefit from the present invention.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A gas supply coupling for delivering combustion gases to a combustion chamber of a heating device, said supply coupling comprising:

a shield adapted to fit within an opening to a combustion chamber;

a stamped single piece fitting affixed to said shield, the fitting including a plate and a stepped tubular connection, said plate having a stepped non-circular shape and having first and second plate sections, said first plate section having an outer perimeter larger than that of said second plate section, said stepped tubular connection extending from said second plate section and including a first portion having a first diameter which gradually necks down to a second portion having a second diameter less than the first diameter;

a gas supply tube affixed to said fitting;

a gas supply line affixed to said fitting; and wherein the gas supply tube contacts the first portion of the fitting and the gas supply line contacts the second portion of the fitting.

2. The gas supply coupling as recited in claim 1, wherein said plate is braised into said shield.

3. The gas supply coupling as recited in claim 1, wherein said gas supply tube is received at least partially within said first portion, and wherein said gas supply line is received at least partially over said second portion such that said gas supply line directly contacts an outer diameter of said second portion.

4. The gas supply coupling as recited in claim 1, wherein the gas supply tube extends through the shield.

5. The gas supply coupling as recited in claim 1, wherein the fitting extends through the shield.

6. The gas supply coupling as recited in claim 1, wherein the heating device includes a burner, and wherein the gas supply tube includes an outlet port near the burner.

7. The gas supply coupling as recited in claim 1, wherein an abutment surface of said first plate section directly abuts said shield.

8. The gas supply coupling as recited in claim 7, wherein said second plate section extends radially outward from said abutment surface.

9. The gas supply coupling as recited in claim 8, wherein said second plate section extends through an opening in said shield.

10. The gas supply coupling as recited in claim 7, wherein said abutment surface engages a substantially planar surface of the shield such that a plane of the abutment surface is generally parallel to the substantially planar surface of the shield.

11. The gas supply coupling as recited in claim 1, wherein the gas supply tube directly contacts the first portion of the fitting and the gas supply line directly contacts the second portion of the fitting.

* * * * *